US007896179B2

(12) United States Patent
Hanaway

(10) Patent No.: US 7,896,179 B2
(45) Date of Patent: Mar. 1, 2011

(54) KNUCKLE PIN FOR RAILWAY VEHICLE COUPLER

(75) Inventor: John Hanaway, Milford, MI (US)

(73) Assignee: General Bearing Corporation, Milford, MI (US)

( * ) Notice: Subject to any disclaimer, the term of this patent is extended or adjusted under 35 U.S.C. 154(b) by 275 days.

(21) Appl. No.: 12/136,823

(22) Filed: Jun. 11, 2008

(65) Prior Publication Data

US 2009/0308830 A1 Dec. 17, 2009

(51) Int. Cl.
*B61G 1/28* (2006.01)
*B61G 1/30* (2006.01)

(52) U.S. Cl. ..... 213/156; 213/155

(58) Field of Classification Search ..... 213/87, 213/155, 156

See application file for complete search history.

(56) References Cited

U.S. PATENT DOCUMENTS

| | | | | |
|---|---|---|---|---|
| 140,715 | A | 7/1873 | Lahman | |
| 418,031 | A | 12/1889 | Kull | |
| 1,372,242 | A | 3/1921 | Mepsted | |
| 1,621,624 | A | 3/1927 | Campo | |
| 2,426,099 | A | 8/1947 | Hershowitz | 280/33.15 |
| 2,447,913 | A | 8/1948 | Robinson | 85/7 |
| 3,145,441 | A | 8/1964 | Strandrud | 24/211 |
| 4,597,499 | A | 7/1986 | Hanula | 213/50.5 |
| 4,976,363 | A | 12/1990 | Altherr | 213/155 |
| 5,009,017 | A * | 4/1991 | Diekevers et al. | 37/456 |
| 5,145,076 | A | 9/1992 | Murphy et al. | 213/155 |
| 5,507,611 | A | 4/1996 | Collister | 411/345 |
| 5,630,519 | A | 5/1997 | Burke et al. | 213/155 |
| 5,685,681 | A | 11/1997 | Smith, II | 411/395 |
| 5,720,193 | A * | 2/1998 | Dick | 70/298 |
| 5,736,088 | A | 4/1998 | Burke et al. | 264/237 |
| 5,823,371 | A | 10/1998 | Riley et al. | 213/75 TC |
| 6,023,927 | A | 2/2000 | Epstein | 59/86 |
| 6,062,406 | A | 5/2000 | Duncan | 213/156 |
| 6,488,163 | B1 | 12/2002 | Wurzer et al. | 213/155 |
| 6,568,894 | B2 | 5/2003 | Golden et al. | 411/351 |
| 6,872,039 | B2 | 3/2005 | Baus et al. | 411/347 |
| 6,994,224 | B2 | 2/2006 | Barger et al. | 213/75 TC |
| 7,147,420 | B2 | 12/2006 | Baus et al. | 411/347 |
| 2005/0147484 | A1 | 7/2005 | Baus et al. | 411/347 |

* cited by examiner

*Primary Examiner* — S. Joseph Morano
*Assistant Examiner* — Zachary Kuhfuss
(74) *Attorney, Agent, or Firm* — Young Basile

(57) ABSTRACT

A knuckle pin retainer for a railroad car coupler adapted for disposition in an aperture formed by a knuckle coupler assembly for connecting adjacent railroad car. The pin retainer includes a pivot pin with a retaining member installed within the pivot pin. The retaining member extends diametrically from a slot in the elongate shaft and is spring-loaded and rotatable within a slot in the shaft. A spring member is disposed within the slot between a back wall of the slot and the retaining member. The spring member is biased to expose the retaining member outside of the slot.

5 Claims, 1 Drawing Sheet

KNUCKLE PIN FOR RAILWAY VEHICLE COUPLER

FIELD OF THE INVENTION

This invention relates to a pin for use in a railroad car coupler assembly.

BACKGROUND OF THE INVENTION

Knuckle coupler assemblies are well known in the railway industry to attach one railroad car to another. Each railroad car to be connected to another railroad car has a coupler. The two couplers of adjacent railroad cars that are about to be coupled each have a knuckle attached to them. When the couplers go together and become coupled, the knuckles snap closed. Thus, you have two couplers, two knuckles, and two thereby formed apertures for the knuckle pins to slip into. A railroad pin is inserted into the through apertures of the knuckles to lock shut the knuckles and secure the connection between the two railcars. However, over time, the alignment of the apertures formed by the connection of the two knuckles and coupler bodies are difficult to attain because of metal wear. Misalignment of the apertures of the knuckle and coupler body reduces the area size of the overall aperture for receiving the railroad pivot pin, making installation of the pin more difficult and potentially hazardous to the railroad worker during connection of the railroad cars.

In addition, cotter pins have been previously used to hold the pivot pin within the aperture of the railroad car coupler. The continued motion of the railroad cars can wear into a specific area of the pin which can cause fatigue and breakage of the cotter pin material.

Another disadvantage of using a cotter pin to secure the pivot pin within the railroad coupler is that installing or removing the cotter pin can be difficult and dangerous to the railroad worker.

SUMMARY OF THE INVENTION

It is the intent of the subject invention to address some of the aforementioned concerns. According to one aspect of the invention a knuckle pin retainer is provided for a railroad car coupler including a pivot pin having an elongate shaft with an exterior surface extending between a first end and second end of the elongate shaft. The first end has a head disposed at the terminating end having an arcuate exterior surface. The arcuate surface terminates at a lip integrally formed to the elongate shaft. The elongate shaft has a constant diameter from the lip of the head to the terminating end of the second end. The elongate shaft further includes a cylindrical slot positioned proximate to the second end which extends through the exterior surface of the shank generally diametrically and terminating before the opposing diametric exterior surface of the shank. A retractable spring-loaded retaining member is disposed within the cylindrical slot.

The invention provides an improved knuckle pin retainer for installation in a knuckle coupler assembly for securing the connection of two adjacent railroad cars that addresses the aforementioned concerns.

Other applications of the present invention will become apparent to those skilled in the art when the following description of the best mode contemplated for practicing the invention is read in conjunction with the accompanying drawings

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
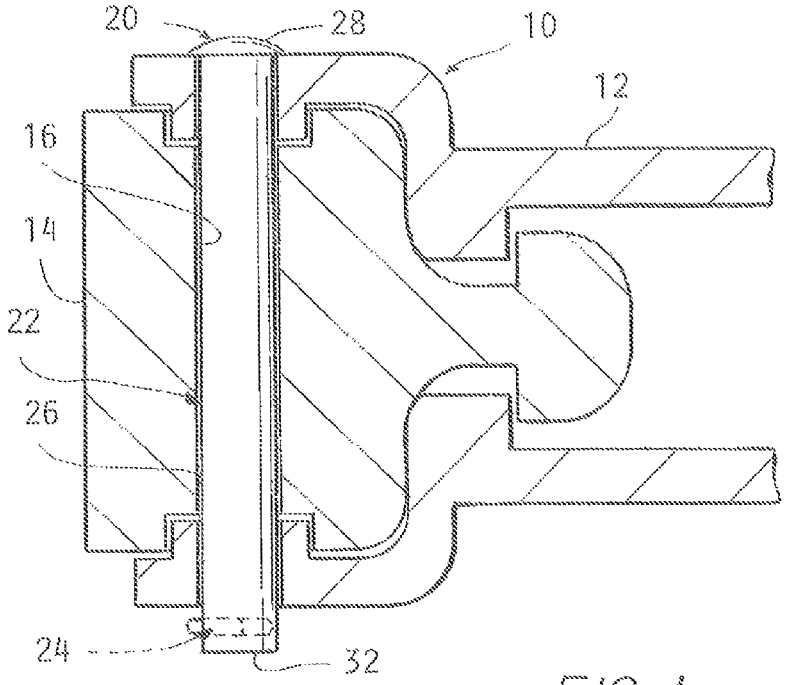
FIG. 1 is a schematic view of a railroad car coupler incorporating a knuckle pin retainer having a retaining member according to the present invention.

The knuckle pin retainer 20 of the present invention is provided to lock a railroad coupler 10 together to securely connect adjacent railroad cars. Referring to the drawings, FIG. 1 shows a schematic of railroad car coupler 10 which can include a yolk 12 and coupler 14. The yolk 12 and coupler 14 interconnect and are secured together by the knuckle pin retainer 20. The yolk 12 and coupler 14 interconnect and form a through aperture 16 therebetween for receiving the knuckle pin retainer 20. The connection of the knuckle pin retainer 20 to the railroad car coupler provides pivotal motion of the connecting railroad cars relative to the adjacent railroad cars.

Figure 2:
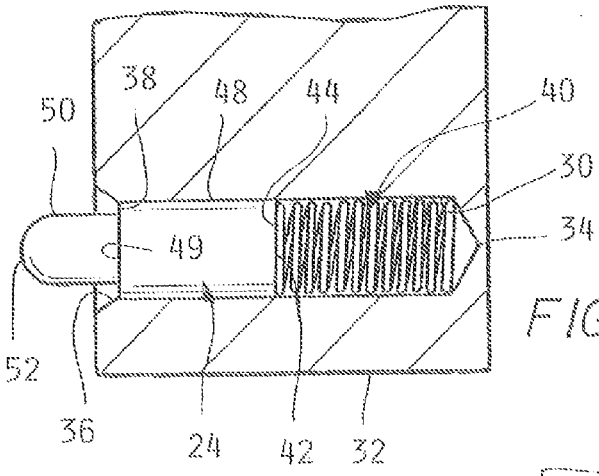
FIG. 2 is a side sectional view of the knuckle pin retainer illustrating certain details of the retaining member and an associated spring.
Figure 3:
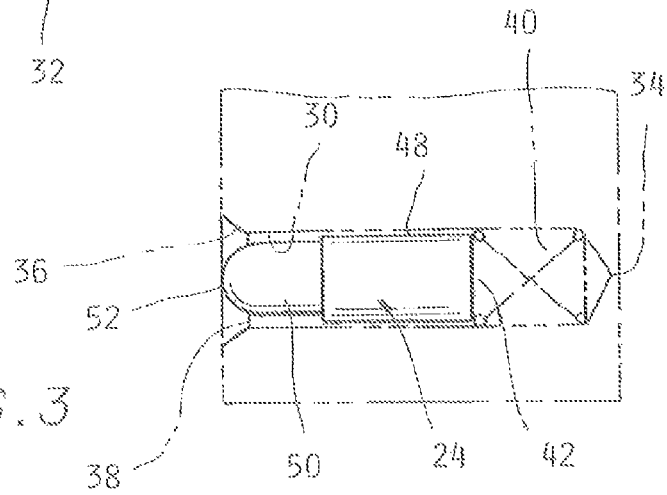
FIG. 3 is an elevational view of the retaining member compressed in the knuckle pin retainer.

Referring to FIGS. 1-3, the knuckle pin retainer 20 includes a pivot pin 22 and a spring-loaded retaining member 24. The pivot pin 22 includes a shaft or shank 26 and a head 28. The pivot pin 22 is made of a solid steel material. The shaft or shank 26 terminates at the head 28. The head 28 is essentially dome shaped. The head 28 is diametrically larger than the diameter of the shaft 26 and the through aperture 16 to provide a stop for the knuckle pin retainer 20 when installed in the through aperture 16 of the railroad car coupler 10. The shaft 26 is a solid cylindrical body preferably made of a treated steel material. The shaft 26 is size to extend beyond the railroad coupler 10 when installed and to have a predetermined length exposed below the coupler for exposure of the retaining member 24 below the railroad coupler 10. The pivot pin 22 can rotate 360° to provide easy installation and removal and further to provide even wear along the axial length of the shaft 26.

At the free end 32 of the shaft 26, a slot or aperture 30 diametrically traverses the shaft 26. The aperture 30 does not extend through to the opposing surface of the shaft 26, but terminates at a point 34 adjacent to the diametrically opposing surface from the opening 36. The opening 36 to the aperture 30 has a circumferential distortion concentric and wider than the diameter of the remainder of the aperture 30. In the illustrated embodiment the circumferential distortion at the entry or opening 36 to the aperture is a beveled edge. The beveled opening 36 facilitates rotatably pressing a retaining member/latch pin 24 into the aperture 30. The beveled opening 36 terminates at a radial point 38 defining a shoulder with a reduced diameter commencing just inside the peripheral outer surface of the shaft 26. The radial point 38 forms a stop to prevent the retaining member 24 from inadvertently escaping the aperture 30 during use.

A spring 40, preferably made of stainless steel, is disposed within the aperture 30 and positioned adjacent the terminating pointed end 34 of the aperture 30. The aperture 30 is coated or filled with a lubricant, such as grease or oil at the spring 40 location to facilitate the compression and expansion of the spring 40. The lubricant also prevents corrosion from water or dirt; and further prevents winter freeze up.

The retaining member/latch pin 24 is rotatably pressed into the aperture 30 so that a rear surface 42 of the latch pin 24 lays against a first end surface 44 of the spring 40. The retaining member 24 has a tubular main body 48 with a constant diameter along the axial length of the main body 48. The diameter of the main body 48 is slightly smaller than the diameter of the aperture 30 between the radial point 38 of the beveled opening 36 and the beginning of the taper for the pointed distal end 34. Clearance between the outer surface of the retaining member 24 and the wall defining the aperture 30 allows for rotatable movement of the retaining member 24 within the aperture 30. The diameter of the main body 48 of the retaining member/latch pin 24 is predetermined to allow the latch pin 24 to rotate within the aperture 30. The rotatable attribute of the latch pin 24 minimized wear on the latch pin 24 during use. The rotational movement of the spring-loaded latch pin 24 also allows for the latch pin 24 to rotatably maneuver within the cavities (not shown) in the wall of the aperture 16 formed by the yolk 12 and coupler 14. Further the ability to rotate facilitates the entry and removal of the retaining member/latch pin 24 from the aperture 30.

The retaining member/latch pin 24 further includes a nose portion 50 integrally formed at the front end 49 of the main body 48. The nose portion 50 has a reduced diameter from the main body 48. The diameter of the nose portion 50 is constant until it terminates at the ball nose 52 which has an arcuate end surface with a radius equaling the radius of the nose portion 50. The arcuate end surface of the ball nose 52 allows the retaining member 24 to easily slide within the through aperture 16 and its cavities (not shown) of the railroad car coupler 10. As the retaining member 24 enters and leaves the coupler 10, the rotational ability of the latch pin 24 minimizes wear along any single surface of the latch pin 24.

Further, as the latch pin 24 enters the through aperture 16 of the coupler 10, the arcuate surface of the ball nose 52 glides over the entry edges to the aperture 16 to prevent nicks and gorges to the latch pin 24. This is especially advantageous when the latch pin 24 has not been fully depressed into slot 30 before the knuckle pin retainer 20 is inserted into the aperture 16 of the coupler 10.

In the prior art, cotter pins have been used with the knuckle pin retainer 20. However, cotter pins do not have the ability to rotate and therefore quickly wear along one surface area during use and when requiring replacement. Further cotter pins require additional manual labor to insert the cotter pin after the pivot pin 22 is installed.

The lengths of the retaining member/pin 24 and spring 40 with the described configuration are such that when the spring 40 is in its normal biased position, the nose portion 50 extends beyond the beveled opening 36 of the aperture 30. In the biased position, the spring 40 urges the retaining member 24 out of the aperture 30. The front end 49 of the main body 48 of the latch pin 24 is stopped by the reduced diameter formed at the radial point 38 of the beveled opening 36. The radial point 38 anchors the retaining member/latch pin 24 and prevents inadvertent removal of the latch pin 24.

The retaining member/latch pin 24 is made of a corrosive resistant material that is plated with a zinc or cadmium material with a di-chromate bake. The resultant latch pin 24 has a gold or yellow hue that is highly visible in contrast to the steel material of the remaining components of the knuckle coupler. This is especially useful during inspection of the railroad cars to check the condition of the latch pin 24. The material of the retaining member/latch pin 24 also provides anti-corrosive properties.

When the shaft 12 is installed in the railroad car coupler 10, the retaining member 24 is retracted into the aperture 30 and thereby compresses the spring 40, as shown in FIG. 3. Once the retaining member 24 clears the aperture 16 of the railroad car couple 10 the spring 40 again biases the retainer member 24 away from the pointed end 34 of the aperture 30 so that the nose portion 50 is exposed out of the aperture 30+In this manner the railroad worker does not have to physically install a cotter pin into the shaft 26. When the nose portion 40 is exposed, vertical movement of the railroad coupler 10 is minimized or prevented. To remove the pivot pin 22 from the railroad coupler 10, the retaining member 24 is depressed against the spring 40 while the pivot pin 22 is raised out of the aperture 16 of the coupler 10. Time and manual expense is reduced in the installation of the pivot pin 22 of the present invention. Further, additional tools are eliminated for the installation and removal of the knuckle pin retainer 20. The knuckle pin retainer 20 of the present invention provides for easy and safe installation and removal that requires minimal manual labor and tools.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law

The invention claimed is:

1. A knuckle pin retainer for use in coupling rail cars together, said retainer comprising:

a pivot pin having a head, an elongate shank extending from the head terminating at a distal end, the shank defining a closed end bore having an opening in an exterior surface of the shank and extending inward terminating prior to exit on a diametrically opposing side of the exterior surface, the bore having a first diameter at the exterior surface and sidewalls extending radially inward and a continuous second diameter along an elongate portion of the bore extending from the sidewalls toward a closed end of the bore, the second diameter smaller than the first bore diameter, the shank exterior surface being substantially continuous and uninterrupted except for the single bore opening, a retaining member axially positioned in the bore having a longitudinal path of travel in the bore, the retainer having a first end, a second end, a spherical shaped nose portion adjacent the first end having a first diameter and a body portion extending from the nose portion having a single continuous second diameter from the nose portion to the second end larger than the nose first diameter, the retaining member first and second diameters are smaller than the bore diameter permitting free rotation of the retaining member in the bore, the portion of the bore in radially surrounding relation to the retainer body portion is substantially continuous in diameter;

a biasing member positioned in the bore between the bore closed end and the retainer second end in longitudinal biasing engagement with the second end of the retaining member to normally bias the first end of the retaining member to extend beyond the bore opening and shank exterior surface; and a stop radially extending into the bore to prevent longitudinal separation of the retainer member from the shank.

2. The knuckle pin retainer of claim 1, wherein the bore first diameter and radially inward extending sidewalls define a beveled opening wherein the sidewalls angularly extend inward toward the bore, wherein the beveled opening and sidewalls provide a guide for easy insertion of the retaining member into the bore and further provides a radial clearance around the nose portion to further facilitate ease of rotation of the retaining member in the bore.

3. The knuckle pin retainer of claim 1, further comprising a lubricant disposed in the bore.

4. The knuckle pin retainer of claim 1, wherein the retaining member is made of a material having a contrasting color from the pivot pin.

5. The knuckle pin retainer of claim 1 wherein the stop is positioned on the radially inward extending sidewall adjacent the bore second diameter.

* * * * *